United States Patent [19]

McMillan

[11] 4,231,166

[45] Nov. 4, 1980

[54] AUTOMATIC CONTROL FOR A CLOTHES DRYER

[75] Inventor: Stephen L. McMillan, Louisville, Ky.

[73] Assignee: General Electric Company, Louisville, Ky.

[21] Appl. No.: 82,838

[22] Filed: Oct. 9, 1979

[51] Int. Cl.[3] ..... F26B 11/04; F26B 21/10; F26B 21/12

[52] U.S. Cl. ..... 34/48; 34/54; 219/364

[58] Field of Search ..... 34/48, 54, 133; 219/364

[56] References Cited

U.S. PATENT DOCUMENTS

| | | | |
|---|---|---|---|
| 3,286,361 | 11/1966 | Cobb et al. | 34/54 |
| 4,086,707 | 5/1978 | Bochan | 34/54 |

*Primary Examiner*—Larry I. Schwartz
*Attorney, Agent, or Firm*—Radford M. Reams

[57] ABSTRACT

An automatic control for a clothes dryer embodying microcomputer controlled apparatus adapted to maintain optimum drying efficiency with minimum risk to the clothes fabrics. The control operates the dryer at maximum heat input rate and a minimum or normal low air flow rate through the drum during the initial warm-up period and the ensuing period during which the moisture removal rate is relatively constant. During these periods, the inlet temperature is monitored and when it exceeds a "fabric-safe" level, the air flow rate is increased and the heat input is reduced preferably after an established time delay to alow conditions to stabilize in the drum after the air flow rate is increased. The control is responsive to outlet air temperature to sense when the moisture removal begins declining to maintain the air flow at the normal low rate, selectively reducing the heat input rate only as needed as determined by the inlet air temperature for safe fabric conditions until the clothes are dry and the drying cycle is terminated.

5 Claims, 4 Drawing Figures

AUTOMATIC CONTROL FOR A CLOTHES DRYER

BACKGROUND OF THE INVENTION

This invention relates to an automatic control system for a clothes dryer and more specifically to a microprocessor-based system which is designed to vary the levels of air flow rate and heat input rate to achieve desirable clothes drying performance at reduced energy usage levels as compared with prior art dryers.

It is known to provide clothes dryers with variable heat control, either of the sort that changes for different stages in the drying cycle or at the selection of the user depending on the nature of the clothes fabrics being dried. It is also known to use a reduced volume flow rate of air through the drum to provide fast warm-up during the initial portion of the drying cycle and also to use reduced air flow rates at the terminal portion of the cycle. There is not believed to be, however, a dryer control system that continually monitors temperature conditions in the dryer so as to control simultaneously both heat input and volume flow rates throughout the drying cycle in such a manner as to achieve as rapid a drying performance as possible without undue risk to the clothes fabric.

BRIEF STATEMENT OF THE INVENTION

Thus, in accordance with the present invention, there is provided an automatic control system for a clothes dryer of the type having a clothes drum, an air flow system for passing drying air through the drum and a heater for heating the air at the inlet side of the drum to enhance the drying effect of the air during the drying cycle. The control system includes first means for sensing the drum inlet air temperature, second means for sensing the drum outlet air temperature and air flow control means for holding the volumetric flow rate of air through the drum normally at a first predetermined rate for the duration of the drying cycle. The air flow control means is responsive to the inlet air temperature sensing means to increase the volumetric air flow rate through the drum, the increase occuring only during an initial warm-up period and the period that immediately follows during which moisture is removed at a relatively constant rate. The increase of air flow is caused to occur when the inlet air temperature exceeds a predetermined temperature level corresponding to a safe operating condition for fabrics in the drum.

The control system of the invention further includes means responsive to the inlet and outlet temperature sensing means and to the air flow control means for controlling the heater to supply normally a high rate of heat to the air and to reduce the heat rate when the inlet air temperature exceeds the level corresponding to a safe operating condition for the fabrics. The heater control is adapted during the warm-up and constant moisture removal rate periods to reduce the heat rate only when the air flow rate is increased. In a preferred embodiment, this latter heat reduction occurs after the air flow rate has been increased for a predetermined time increment. Also in the preferred embodiment, the heater control is further responsive to the outlet air temperature sensor to maintain the rate of heat applied to the air at the reduced rate when the outlet air temperature reaches a predetermined temperature representative of the commencement of the period of declining rate of moisture removal from the clothes.

The control system finally includes means for terminating the dryer operation at the conclusion of the drying circle.

DESCRIPTION OF THE PREFERRED EMBODIMENT

Figure 1:
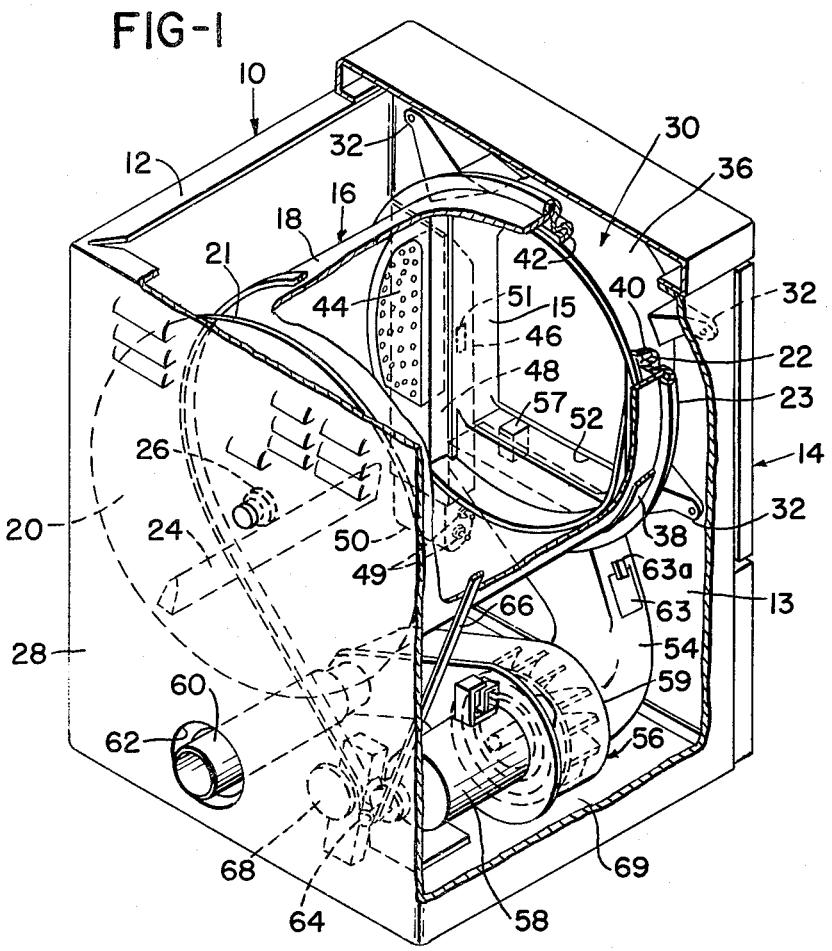
FIG. 1 is a perspective view, partially cut away, of a dryer illustrating various constructional details thereof and incorporating the preferred embodiment of the invention.

Referring now to the drawings, there is illustrated a clothes dryer 10 including an appearance and protective outer cabinet 12 having an access door 14 which is hingedly secured to the front wall 13 of the cabinet 12. Within cabinet 12, there is provided a clothes tumbling container or drum 16 mounted for rotation about a horizontal central axis. Drum 16 is cylindrical in shape and has a cylindrical side wall 18, a rear circular imperforate wall portion 20 secured to the cylindrical side wall 18 as by a crimped flange generally shown around the periphery of the circular wall portion 20 as 21. The front drum portion 22 is a circular member also secured to the cylindrical side wall 18 by a crimped flange 23 and has a circular opening surrounding an access opening 15. Drum portions 18 and 20 are imperforate while the front of the drum has the access opening 15 for placing in and removing clothes from the drum interior. The access door 14 covers the access opening 15 and seals it when the machine is being operated.

Such clothes dryers are conventionally provided with a control arrangement such that the operator, by manually setting a control knob (not shown) and actuating a second push-to-start switch (not shown), causes the machine to start and automatically proceed through a desired drying cycle. The clothes dryer also has a normally open or "off" switch associated with the door, such that unless the access door is closed, the machine cannot be operated.

Around the interior surface of the cylindrical side wall 18, there is a plurality of clothes tumbling ribs or baffles shown generally as 24 so that the clothes are lifted up when the drum rotates and then permitted to tumble back down to the bottom of the drum. The drum 16 is rotatably supported within the cabinet 12 at the rear thereof by a central stub bearing axle assembly 26 that supports the drum at the center of the rear circular wall 20. The axle is secured directly to the rear wall 28 of cabinet 12.

The front of the drum 16 is rotatably supported on a large circular component 30 which has the access opening 15 at the front of the drum. This large circular component 30 may be a plastic molded unitary structure which is secured to the front of the machine by screws or other suitable securing means through support arms 32 integrally molded with the large circular component 30. Located in the bottom or lower portion of the large circular component 30 is a curved channel opening inwardly toward the drum 16 and is formed by an inner circumferential ring 36, and an outer curved segment member 38 spaced from the inner ring 36. The forward end of cylindrical side wall 18 fits inside the channel and rests on two slide members (not shown) each located on the inner surface of the outer curved segment 38 on opposite ends of the segment 38 to slidably support the front portion of the drum 16. In this manner then the drum may be rotated and is supported in its proper position within cabinet 12 at the front by the slide members and at the rear by central stub bearing assembly 26. The front drum portion 22 which is circumferentially secured by crimped flange 23 to the forward portion of the cylindrical wall 18 has secured at its end 40 a suitable flexible circumferential seal member 42 that will by its structure be urged against the outer surface of inner circumferential ring 36 of component 30 to thereby effect a rotatable seal against air flow leakage from the drum.

The large circular component 30 also includes, as part of an air flow system for the dryer, an air inlet opening 44 into the drum. The air inlet opening 44 is in direct communication with duct 46 that is directed vertically upward from beneath the drum 16. Within this duct 46 generally located in portion 48 thereof, there is suitable air heating means, such as an electrical resistance heating element having terminal connecting ends 49 for receiving electrical power being supplied to the machine. The lower portion of duct 46 has an opening 50 for receiving ambient air. First temperature sensing means such as a thermister 51 may be positioned within duct 46 downstream of the heating means for sensing the temperature of the air at the inlet to the drum.

In order for the air flow to exit the interior of drum 16, there is provided at the front of the drum and molded into the large circular component 30 an air outlet opening 52. This air outlet is in air flow communication with a blower 56 through duct 54. Air outlet opening 52 is normally fitted with a lint trap or screen member (not shown) covering the air outlet opening for screening lint from the air flow. Within duct 54, ther is temperature sensing means such as a thermister 57 for sensing the temperature of air exiting the drum at the outlet thereof.

There is also provided within the laundry machine a single speed electric motor 58 for driving the driven components of the machine. The electric motor 58 in the preferred embodiment has a full speed of 1725 RPM, however, other rated single speed electric motors may be used, if desired. Motor 58 is part of the air flow system and, as such, motor shaft extending toward the front of the machine is connected to a blower wheel 59 contained within the blower assembly 56 for causing the air to flow through the system within the machine. Air leaving the blower assembly 56 may be expelled from the machine through an air conduit 60 that projects through an opening 62 in the rear wall 28 of cabinet 12.

In accordance with one aspect of the invention, the volumetric air flow rate through drum 16 is controlled to different flow rates by means of a bypass damper 63. Damper 63 is activated by a solenoid **63*a* such that, when opened, the air flow through drum 16 is reduced while at the same time the bypass air drawn in through damper 63 serves to maintain a suitable high velocity of air flow through exhaust duct 60**.

The motor shaft extending toward the rear of the machine has secured to it a belt pulley 64 for driving an endless belt 66 which wraps around the cylindrical side wall 18 of the drum so that the electric motor through the belt pulley and belt cause the drum 16 to be rotated and thereby effect tumbling of the clothes within the drum. To take up any slack in the belt 66, there is a belt tension assembly 68 provided and may be secured to the base 69 of cabinet 12.

The operation of the laundry machine is generally as follows: clothes are placed in the drum by opening the door 14 and passing them through access opening 15 into the interior of the drum 16. When the door 14 is closed, the automatic controls and components of the machine may be energized by setting a control knob and actuating the push-to-start switch causing the electric motor to be energized and thus the blower wheel 59 to rotate at the same speed as the full speed of the electric motor 58, which in the preferred embodiment is 1725 RPM, and produce an air flow through the machine. The drum is also rotated through the belt drive but at greatly reduced velocity due to the difference in circumference between the pulley 64 and the cylindrical side wall 18 of the drum 16. Ambient outside air may be introduced into the interior of the machine through louvers 70 in the rear wall 28 of cabinet 12. The air inside the cabinet enters the bottom opening 50 of duct 46, passes through the heating element area inside duct 48 where it is warmed and then enters the drum 16 through air inlet opening 44. The air will exit the drum at the front thereof through air outlet opening 52. The air will then pass over thermostatic switch 57, through duct 54, blower assembly 56, and exit the machine through air conduit 60. While the clothes dryer described and shown in the drawings has air entering and exiting the drum at the front, this invention may be used with other air flow systems for dryers.

Figure 2:
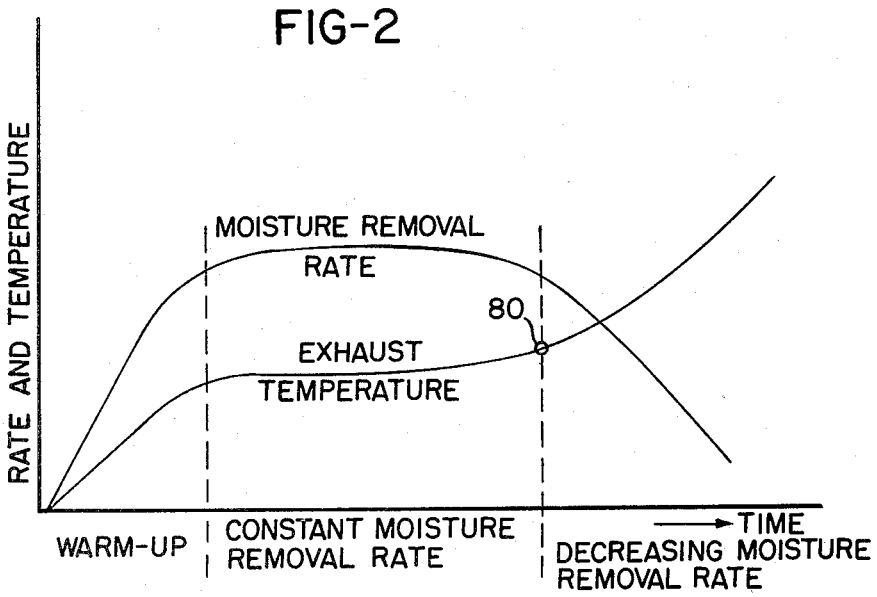
FIG. 2 is a graph of the drying cycle of the dryer of FIG. 1.

Shown in FIG. 2 is a graph of a typical drying cycle illustrating the variation of drum exhaust air temperature and rate of moisture removal from the clothes load over the duration of the drying cycle. Thus, during the initial warm-up period, the heat supplied to the dryer air is taken mostly to raise the temperature of the dryer and the wet clothes load. With increased heat-up of the clothes load and drum structure, the rate at which moisture is removed increases until a point of stability is reached at which, for a given heat input rate, the rate of moisture removal remains fairly constant. This is shown in the second period of the cycle during which outlet air temperature and moisture removal rate curves are fairly flat. An exemplary outlet air temperature for this period might be 120° F. The maximum heat input rate of the dryer of FIG. 1 is a function of the maximum BTU capacity of the heater expressed in terms of wattage in the case of electrical resistance heaters. For any given dryer cycle, the maximum heat input rate may be the rate as limited by the heater rating or it may be a lower rate as selected by a user operated control for sensitive fabric contents. Thus any reference in this specification and claims to maximum or predetermined high heat input rates is to be interpreted as the highest permitted heat rate for the cycle selected irrespective of the maximum rate possible based on BTU capacity of the heater.

Eventually, as the drying cycle progresses, the moisture content of the clothes load declines to the point at which the vaporization rate, or moisture removal rate, is insufficient to absorb the established rate of heat input. When this occurs, the temperature of the discharge air begins to rise to and potentially above an elevated outlet temperature level of, for example, 160° F. indicated at point 80 which indicates the commencement of a third period in the drying cycle at which reduced heat input is needed for optimum drying efficiency. Based on the fundamentals illustrated in the graph of FIG. 2, and in accordance with the present invention, a control system is possible which can be responsive to temperature conditions in the dryer to tailor the rate of heat input and air flow rate to minimize the total drying cycle time without undue risk to the clothes fabric as will now be described.

Figure 3:
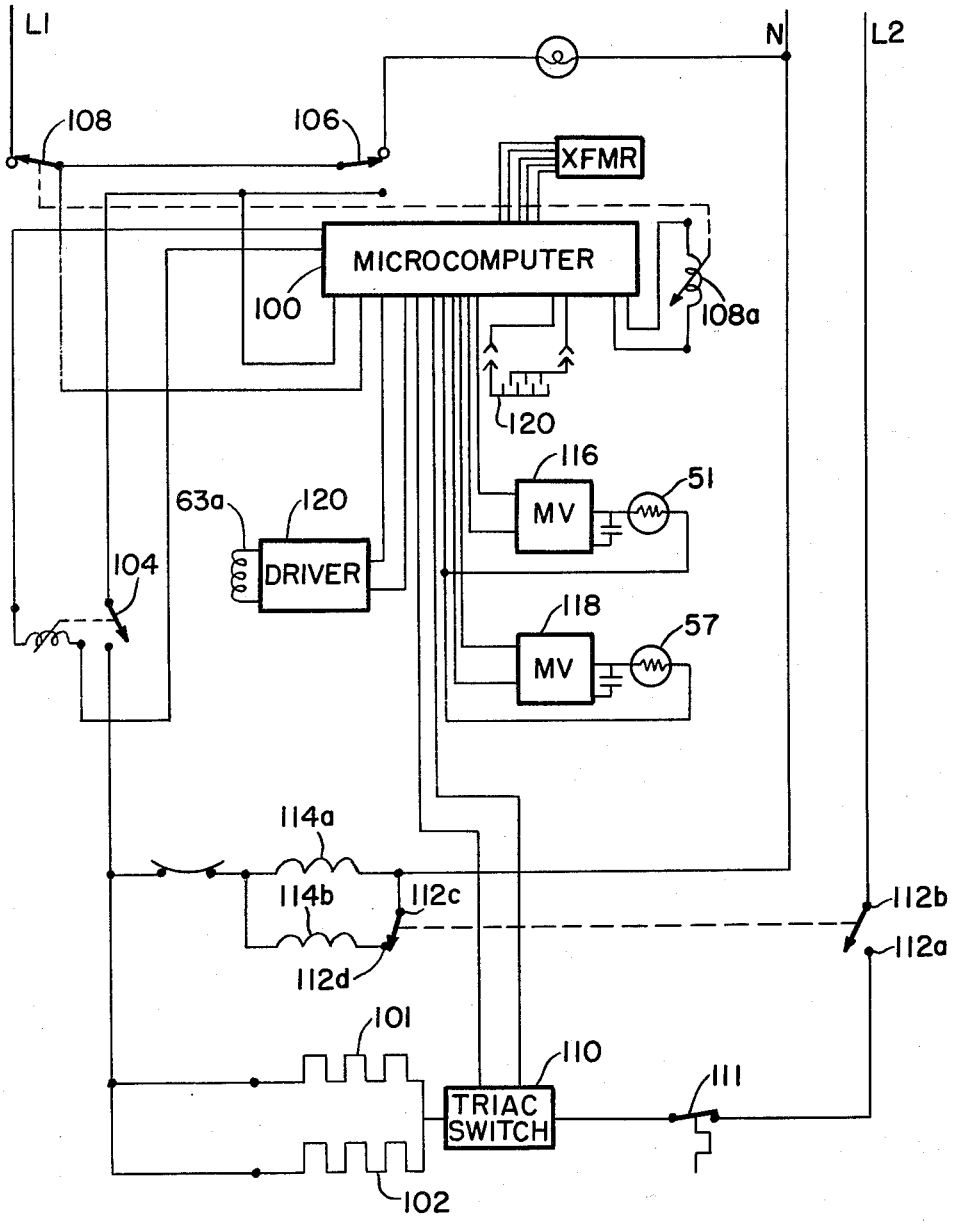
FIG. 3 is a partly block diagram and partly schematic representation of the control system of the present invention.
Figure 4:
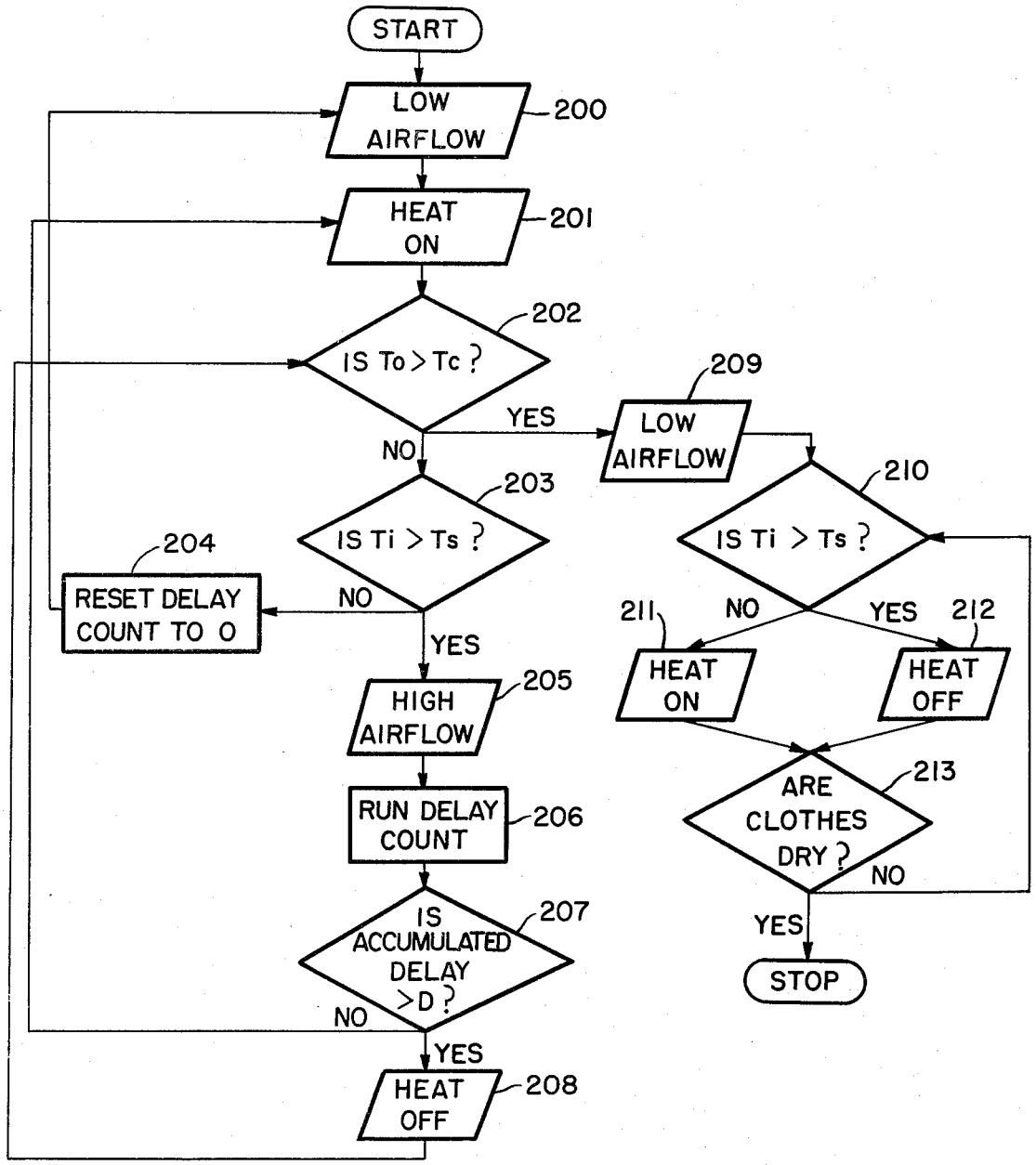
FIG. 4 is a program flow diagram showing the manner in which the microcomputer of the FIG. 3 control system can be preprogrammed in accordance with the present invention.

Referring now to FIG. 3, a clothes dryer control system is shown in which a preprogrammed microcomputer 100 is employed to direct the functional operation of the various control system components in the manner shown by the program flow diagram of FIG. 4. Heaters 101, 102 are connected on one side through relay switch 104, door switch 106 and on/off switch 108 to line terminal $L_1$. The other side of heaters 101, 102 are connected through a solid state power switching circuit 110, high limit switch 111, and centrifugal switch contacts 112*a*, 112*b* to line terminal $L_2$. Terminas $L_1$, $L_2$ are adapted for connection to a conventional 240 volt mains supply. A drum light 107 is connected across terminal $L_1$ and neutral terminal N via door switch 106 and on/-off switch 108. Run winding 114*a* of drive motor 58 is connected across line terminal $L_1$ and neutral terminal N of the mains supply. Start winding 114*b* is coupled across run winding 114*a* by means of a second set of centrifugal switch contacts 112*c*, 112*d*. To initiate operation, a mechanically actuated on-off switch 108 is depressed to apply power to the microcomputer 100 which, in turn, generates a holding potential across relay coil 108*a* to hold switch 108 closed. Relay switch 104 is closed by a signal from the microprocessor when a heated dry cycle is initiated by the user at the control panel of the dryer.

In accordance with the invention, the control system comprises first means including thermistor 51 and a triggered multivibrator circuit 116 for sensing the drum inlet air temperature and second means including thermister 57 and triggered multivibrator circuit 118 for sensing the drum outlet air temperature. Sensing of the inlet and outlet temperatures is initiated at appropriate times in the timing cycle by the microcomputer 100 which sends a pulse to trigger the respective multivibrator 116 or 118. When triggered, the multivibrators 116, 118 each return a pulse to the microcomputer 100, the width of which varies with the temperature dependent resistance of the corresponding thermistors 51, 57. When a pulse is received, microcomputer 100 decrements an internal counter for the pulse duration, the resultant count being representative of the temperature being sensed.

Air flow control means includes damper solenoid 63*a*, driver circuit 120 and the appropriate preprogrammed segments of microcomputer 100 which suitably actuates solenoid 63*a* to maintain damper 63 (FIG. 1) in a normally open condition to hold the volumetric air flow rate of air through drum 16 normally at a first predetermined or low rate for the duration of the drying cycle. With a low air flow rate, a rapid heat-up of the drum and clothes occurs during the warm-up period. Additionally, during the constant moisture removal rate period the low air flow rate, coupled with the maximum heat input rate described below allows optimum drying efficiency. In order to avoid overheating the clothes during these periods, the air flow means is actuated by means of the programmed instructions of microcomputer 100 generated in response to the inlet air temperature sensing thermistor 51 to increase the volumetric air flow rate through drum 16, only during the warm-up and constant moisture removal rate periods of the drying cycle, when the inlet air temperature exceeds a predetermined temperature level corresponding to a maximum safe operating condition for clothes fabrics in the drum 16. This latter temperature level may, for example, be a fixed value of 280° F. or any one of a number of temperature levels selectable by the user via a manually operated control on the dryer.

Means including the appropriate preprogrammed segment of microcomputer 100 and switching circuit 110 are provided for controlling heaters 101, 102 to supply normally a predetermined high or maximum rate of heat to the air at the drum inlet 44. Switching circuit 110 may be any one of a number of known solid state proportional switching devices operable by means of control signals from microcomputer 100. Preferably, switching circuit 110 also includes a zero crossing detector circuit to minimize electromagnetic interference. As previously explained, the high heat input rate maximizes the moisture removal rate. However, to assure the clothes are not overheated, the heater control means is actuated by the programmed instructions of microcomputer 100 generated in response to the inlet air temperature thermistor 51 and to the air flow control means, during the warm-up and constant moisture rate periods, to reduce the rate of heat applied to the air only when the air flow rate is increased. Thus, in accordance with one aspect of the invention, the heat rate is not reduced during the first two periods of the drying cycle unless the air flow rate is also raised thus assuring optimum drying efficiency during the cycle. Preferably, a programmed time delay of, for example 10 seconds, is provided after the air flow rate has been increased to allow for stabilization of conditions in the drum before determining the need to reduce the heat input rate. Thus, in accordance with a further aspect of the invention, the heat rate is reduced during the warm-up and constant removal rate periods only after the air flow rate has been increased for a predetermined time increment and only if the inlet temperature remains excessive, to further optimize the drying efficiency. The heater control means is further responsive to the outlet air temperature thermistor 57 to maintain the air flow rate at a predetermined low rate after the outlet air temperature reaches a predetermined temperature, for example 160° F. representative of the commencement of the period of decreasing rate of moisture removal. In this third period, the heat control continues to be responsive to the inlet air temperature thermistor 51 to reduce the heat input rate when the inlet air temperature reaches the elevated level corresponding to a maximum safe operating condition for the clothes fabrics in the drum 16.

The control apparatus of the invention further includes means for terminating the dryer operation at the conclusion of the drying cycle. This cycle terminating means may be a timer, operative at the commencement of the above described third period of the drying cycle, to time out and shut off the dryer at the end of a fixed time period in well known manner. Alternatively, it may include moisture sensor 120 which operates with programmed instructions in microcomputer 100 to shut off the dryer when a certain moisture level, such as 4%, is reached in the clothes load.

Referring now to FIG. 4, the program flow diagram for microcomputer 100 insofar as it is relevant to the air flow means and heater control means of the invention will now be considered. Thus upon entry into the control program the instruction is given to establish low air flow rate, by opening damper 63, and to initiate full power cycling of heaters 101, 102 (assuming selection of a heated air dry cycle by the user). Following this, the microcomputer determines by inquiry 202 whether the outlet air temperature $T_o$ is greater than a predetermined level $T_c$, e.g. 160° F. corresponding to the temperature which signals entry into the third (decreasing moisture removal rate) period of the drying cycle. At the outset the answer would be "no" thus leading to the inquiry 203 whether the inlet air temperature $T_i$ is greater than a maximum safe value as selected by the user from one of several stored in microcomputer memory related to fabric content. If the answer is "no", an internal delay counter is reset by instruction to a "0" count and the program recycles in the normal condition as just described.

If, on the other hand, the inlet temperature exceeds the selected maximum safe temperature for the fabrics (keeping in mind this inquiry is made only during the first and second periods of the drying cycle by virtue of its being made only as long as the outlet air temperature is sensed to be less than 160° by inquiry 202), instruction 205 causes a control signal to actuate solenoid 63*a* to close damper 63 thus raising the air flow rate through dryer 16. This is followed by a further instruction 206 which initiates a delay counter. As long as inquiry 207 indicates the predetermined time delay has not been exceeded the control program will continue to cycle with high heat input rate and high air flow rate. Once inquiry 207 determines the time delay has been exceeded without reduction of inlet temperature $T_i$ below the "safe" temperature $T_s$, the heater control circuit 110 will be actuated, either by reducing the switching duty cycle or by turning off the heaters 101, 102 so as to lower the heat input rate. Once inquiry 203 determines the inlet temperature $T_i$ has fallen below $T_s$, the delay counter will be reset to a "0" count, the air flow rate is reduced by instruction 200 and the control program returns to its normal cycle.

Eventually, the clothes will dry to the point at which the outlet temperature will reach the elevated temperatures, e.g. 160° F. indicative of entering the third drying period. The program at this point branches out from inquiry 202 to a subroutine commencing with instruction 209 which maintains the low air flow rate through the drum 16. Thereafter, the program cycles the heaters appropriately, as previously described, dependent on the inlet air temperature until the clothes are dry as determined by inquiry 213 which preferably operates in the dryer control of FIG. 4 in conjunction with moisture sensor 120. When the clothes are dry, microcomputer 100 terminates the holding potential across relay coil 108*a* thus causing switch 108 to open and remove power from the dryer.

While, in accordance with the patent statutes, there has been described what at present is considered to be the preferred embodiment of the invention, it will be apparent to those skilled in the art that various changes and modifications may be made therein without departing from the invention. It is intended, therefore, by the appended claims to cover all such changes and modifications as fall within the true spirit and scope of the invention.

What is claimed is:

1. An automatic control system for a clothes dryer of the type having a clothes drum, an air flow system for passing drying air through the drum and a heater for heating the air at the inlet side of the drum to enhance the drying effect of the air during the drying cycle, the drying cycle having an initial warm-up period, followed by a period of a relatively constant moisture removal rate followed by a period of a decreasing moisture removal rate, the control system comprising:

means for sensing the drum inlet air temperature;

means for sensing the drum outlet air temperature;

air flow control means for holding the volumetric flow rate of air through the drum normally at a first predetermined rate for the duration of the drying cycle and being responsive to the inlet air temperature sensing means to increase the volumetric air flow rate through the drum, only during the warm-up and constant moisture rate periods, when the inlet air temperature exceeds a predetermined elevated temperature level corresponding to a maximum safe operating condition for fabrics in the drum;

means responsive to the inlet and outlet temperature sensing means and to the air flow control means for controlling the heater to normally supply a predetermined high rate of heat to the dryer air and for reducing the heat rate when the inlet air temperature reaches said predetermined elevated temperature level, said heat rate reduction adapted during the warm-up and constant moisture removal rate periods to occur only when increased air flow rate exists but fails to hold inlet air temperature below said elevated temperature level;

and means for terminating the dryer operation at the conclusion of the drying cycle.

2. The automatic control system of claim 1 in which the air flow control means is adapted to reduce the air flow rate to the first predetermined rate at any time during the warm-up and constant moisture removal rate periods that the inlet air temperature falls below said predetermined elevated temperature level.

3. The automatic control system of claim 1 in which the air flow system includes an air blower and the air flow control means includes a damper mechanism adapted to introduce drum bypass air to the blower whereby a constant exhaust air flow rate is maintained when the volumetric air flow rate through the dryer is reduced.

4. The automatic control system of claim 1 in which the heater control means is adapted to reduce the heat rate to the inlet air during the warm-up and constant moisture removal rate periods only after the air flow rate has been increased for a predetermined time increment during which the inlet air temperature has remained above said elevated temperature level.

5. The automatic control system of claim 1 in which the air flow control means is responsive to the outlet air temperature sensing means to maintain the air flow rate at a predetermined low rate after the outlet air temperature reaches an elevated temperature level indicative of the commencement of a declining rate of moisture removal from the clothes load.

* * * * *